United States Patent [19]

Güttinger

[11] Patent Number: 5,011,386

[45] Date of Patent: Apr. 30, 1991

[54] ROTARY POSITIVE DISPLACEMENT MACHINE FOR INCOMPRESSIBLE MEDIA

[75] Inventor: Kurt Güttinger, Murten, Switzerland

[73] Assignee: Gutag Innovations AG, Murten, Switzerland

[21] Appl. No.: 409,324

[22] Filed: Sep. 19, 1989

[30] Foreign Application Priority Data

Sep. 20, 1988 [CH] Switzerland ..... 03493/88

[51] Int. Cl.[5] ..... F04C 2/04

[52] U.S. Cl. ..... 418/59

[58] Field of Search ..... 418/49, 50, 51, 52, 418/59, 150

[56] References Cited

U.S. PATENT DOCUMENTS

| | | | |
|---|---|---|---|
| 3,125,032 | 3/1964 | Smith | 418/59 |
| 3,195,470 | 7/1965 | Smith | 418/59 X |
| 3,560,119 | 2/1971 | Busch et al. . | |
| 3,782,865 | 1/1974 | Braun | 418/59 X |
| 3,989,422 | 11/1976 | Güttinger . | |
| 4,121,438 | 10/1978 | McCullough . | |
| 4,325,683 | 4/1982 | Miyazawa . | |
| 4,437,820 | 3/1984 | Terauchi et al. . | |
| 4,606,711 | 8/1986 | Mitsui et al. . | |
| 4,789,315 | 12/1988 | Guettinger . | |

FOREIGN PATENT DOCUMENTS

| | | |
|---|---|---|
| 177654 | 8/1905 | Fed. Rep. of Germany . |

*Primary Examiner*—Michael Koczo

*Attorney, Agent, or Firm*—Burns, Doane, Swecker & Mathis

[57] ABSTRACT

In a positive displacement machine for incompressible media, with a working chamber (4) located in a stationary housing (1, 2) and having the configuration of a circular slot, a circular displacer body (8) located in said working chamber, is being held on a disk shaped rotor (3) driven eccentrically relative to the housing. The displacer body contacts the inner and outer circumferential walls of the working chamber at least one sealing line continuously progressing in operation, whereby the medium is conveyed from an inlet (6) to an outlet (7). The inlet is separated from the outlet by a land (5) extending radially in the working chamber (4). For the guidance of the displacer body relative to the housing an Oldham (cross keyed) coupling (9, 10) is provided, and for the circular drive of the displacer body a wobble rod (12, 12') is connected with a driving crank drive (13). In the area of the land (5) the inner and outer work spaces (27, 28) communicate with each other at the inlet (6) and the outlet (7). The displacer body (8) and the working chamber (4) have a circular configuration over the overwhelming part of their configuration. The ends on the inlet and the outlet sides of the displacer body and the working chamber, in an angular zone ($\alpha$) of maximum 30°, have significantly smaller radii of curvature than that of the overwhelming circumference.

13 Claims, 5 Drawing Sheets

ROTARY POSITIVE DISPLACEMENT MACHINE FOR INCOMPRESSIBLE MEDIA

BACKGROUND OF THE INVENTION

1. Field of the Invention

The present invention relates to positive displacement machines for incompressible media.

2. Discussion of Related Art

Positive displacement machines with circular displacement bodies for liquids have been known since 1905, as disclosed in DE 177 654. However, such a machine was an annular piston extending into the conveying chamber in an oscillating manner, for which it is guided on the land separating the inlet from the outlet. It is driven by a crank on which it is mounted by means of a hub. This machine is characterized allegedly by an uninterrupted and uniform discharge.

Another displacement machine, not with circular but with heart shaped displacement vanes, is disclosed in WO 86/05241. In this pump displacement, vanes are moved simultaneously in a cyclic motion relative to their chambers by means of a crank drive. A radially adjustable element produces a driving force with radial and tangential components acting on the support of the displacement vanes, so that the latter always remain in a sealing contact with their chambers. The adjustable element may act in the manner of a spring, a wedge, or by any other frictional but not positive means. The support carrying the displacement vanes does not tilt in any position because of the opposing contact locations of the vanes arranged in a ring.

Similar displacement machines with a wobble drive are disclosed in DE 2 603 462 and U.S. Pat. No. 3,560,119. Other machines of this type with an Oldham coupling are also disclosed in EP 10930 B1, U.S. Pat. No. 4,437,820 and DE 27 35 664. All of these installations are so-called displacement machines for compressible media. They each comprise a working chamber defined by helical circumferential walls extending vertically from a side wall and leading from an inlet located outside the helices to an outlet inside the helices. They further contain a helical displacement body extending into the working chamber. The latter is supported rotatingly without rotation relative to the working chamber. Its center is eccentrically offset relative to the center of the circumferential walls, so that the displacement body is always in contact with both the outer and the inner circumferential wall of the working chamber along at least one advancing line. During the operation of the machine therefore a plurality of sickle shaped working spaces are enclosed. The working spaces move from the inlet to the outlet through the working chamber. Depending on the angle of contact of the helix, the volume of the working medium conveyed may be gradually reduced with a corresponding increase of the pressure of said medium.

In those known machines, the tumble drive is always the means to convert the rotating motion of the driving machine into the translatory motion of the displacer.

The drive solution in DE 2,603,462 consists of an eccentric body mounted with a counter weight on the drive shaft, upon which a drive disk is located by means of a ball bearing. The latter is equipped with four ball jointed sockets in which the ball end of the wobble rod is located. The balls there are only in line contact with their sockets. During a rotating motion of the drive shaft, the rotor body is placed into a circling but not rotating motion by the wobble rods. In addition to the driving function, in this solution the wobble rods also secure the body against rotation.

In the configuration according to U.S. Pat. No. 3,560,119, the pivot of the wobble rod on the drive side is supported rotatingly and pivotingly in an eccentric position by means of a pendulum ball bearing. To prevent the rotation of the displacer itself, the second and third ball sections are provided with sectional crowns, for example, teeth, which engage the correspondingly profiled counter pieces in the displacer and the stationary housing part and are pivotingly supported in them. The wobble shaft is axially secured by means of a retaining disk fitting into the stationary housing part.

In the known machines, the relative rotating motion is always transmitted by a highly stressed and thus expensive ball bearing. Furthermore, no measure is provided to insure the operation without clearance of the machine in case of the wear of the material of the wobble rod or rods. In all of those known machines, Oldham (cross-keyed) couplings are the rotation inhibiting means for the displacer. Radial displacement is limited by the contact of the helical ribs with the walls of the working chambers. This limitation theoretically corresponds to a circle, in this case a translational circle. The displacer, which is not rotating relative to the working chamber, must be guided by means of the Oldham coupling in a manner such that the parallel guidance permits a larger diameter than that corresponding to the diameter of the translation circle. The reason for this is the fact that the radial displacement of the displacer is to be limited by the rib/chamber wall combination and not by the guiding Oldham coupling. Using this rule, the dimensions of the Oldham coupling are readily determined.

It is generally believed that such Oldham couplings are not suitable for the transmission of large torques and high rpm in view of the bending fatigue exposure and frictional losses.

In all of the known Oldham couplings the lands consist of rectangular blocks engaging correspondingly shaped grooves. The objections to the use of Oldham couplings is understandable to the extent that the lateral clearance in the grooves must be minimal for uniform guidance. However, this necessarily leads to frictional surfaces which tend to wear. In addition, dirt may penetrate the coupling and jam the parts, which interferes with the operation of the coupling.

SUMMARY OF THE INVENTION

It is therefore an object of the invention to develop a rotating piston positive displacement pump with very low pulsations, so that no clearance remains even in the case of increasing wear of the materials.

This object is attained according to the present invention by that:

- in the area of the land, the inner and outer working chambers are in communication with each other,
- the displacer body and the working chamber have at least approximately a circular configuration over the overwhelming part of their circumference,
- the displacer body seals over at least 360 degrees,
- for which, the ends on the inlet and outlet side of the displacer body and working chamber over an angular range of maximum 30 degrees have significantly smaller radii of curvature than those of the greater part of the circumference.

An advantage of the present invention is to be found in that the novel configuration creates a self-priming, low pulsation, self-adjusting pump that is nearly free of maintenance.

It is especially advantageous to seat the wobble rod at its end at the crank side with a spherical section in a universally displaceable articulation socket of the crank. The other end is seated with a spherical section in hemispherical articulation socket of the stationary housing part, and, the wobble rod is provided between its two ends with a spherical section supported rotatingly and in a wobbling manner in a hemispherical articulation socket in the displacer, with spring means insuring the full abutment of the spherical sections in the articulation sockets.

This driving mode involves very short frictional paths and thus low frictional losses.

It is further appropriate to provide an Oldham coupling with a freely moving intermediate ring carrying on its flat sides two convex lands set at 90 degrees to each other, which engage corresponding concave grooves in the parts to be coupled, wherein the intermediate ring, together with its lands, consists of spring steel. This highly cost effective element, in addition to guidance, also provides the contact pressure for the displacement body against the bottom of the working chamber.

BRIEF DESCRIPTION OF THE DRAWINGS

The drawing schematically illustrates several examples of the present invention relative to a liquid pump. In the drawings.

DETAILED DESCRIPTION OF THE PREFERRED EMBODIMENT

Figure 1:
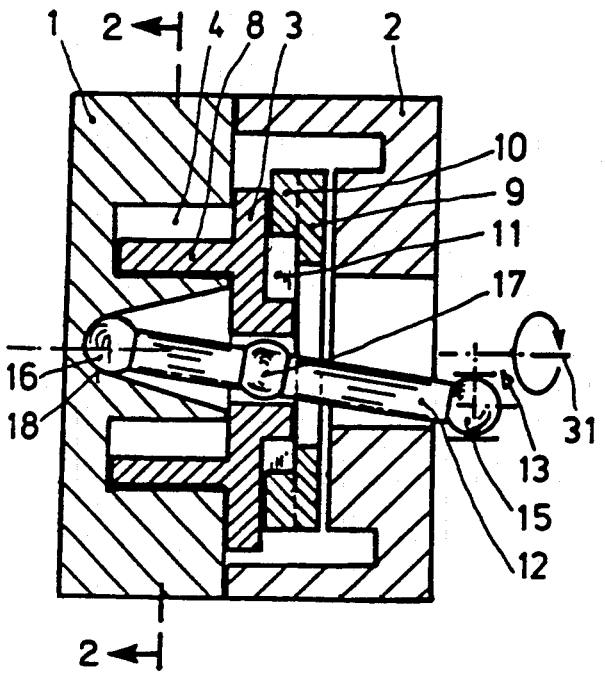
FIG. 1 is a longitudinal cross section through the pump with revolving piston.
Figure 2:
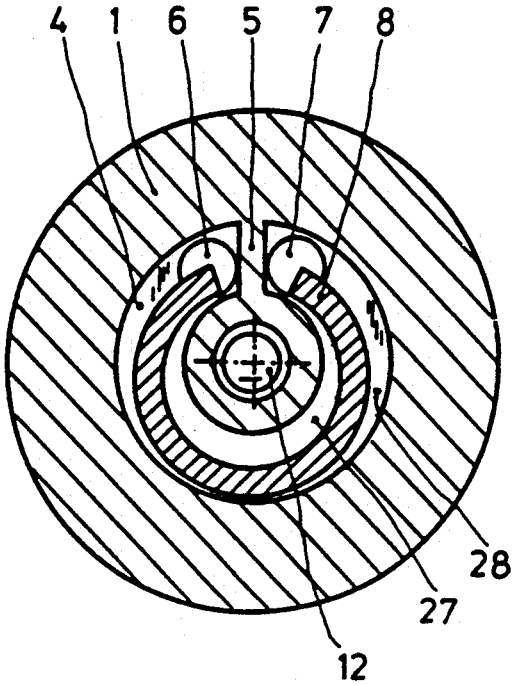
FIG. 2 is a cross section through the pump on the line 2—2 in FIG. 1.

In a simplified view of a pump according to FIGS. 1 and 2, only the parts essential for a comprehension of the invention are shown. In the different figures identical parts are designated by the same reference symbols.

Relative to the mode of operation of the pump, which in itself is not an object of the invention, reference is made to the aforecited WO 86/05241. In the following, only the machine configuration and the process are briefly described.

The pump according to FIGS. 1 and 2 essentially consists of two housings halves 1, 2, connected in a suitable manner with each other, and the displacer inserted in between, together with its drive and guide. An annular working chamber 4 is located in the left half 1 of the housing. The annular working chamber 4 has uniformly spaced, parallel, circumferential walls enclosing an angular area of approximately 360 degrees, even if not visible in FIG. 2. The chamber is divided by a land 5 extending over the entire depth of the chamber. On either side of the land, in the rear wall of the housing half 1, an inlet 6 and an outlet 7 for the working medium to be conveyed, are located. A displacer body 8 is located within the working chamber 4 between the circumferential walls. The curvature of the displacer body 8 is such that the displacer body 8 is in contact with the inner and outer circumferential wall of the working chamber on at least one continuously progressing sealing line. The displacer body 8, which thus represents the annular piston, is a rib held perpendicularly on a rotor disk 3. The displacer body 8 is slit in a location opposite the land 5, i.e., interrupted over its entire depth.

In operation, the rotor 3, together with the displacement body 8, referred to hereinafter as the displacer, performs an orbital motion. During this revolving motion the displacer is always in contact with both the inner and the outer circumferential walls of the working chamber 4. This contact results in the formation of working spaces 27, 28 on either side of the displacer for enclosing the working medium. The working spaces are displaced by the rotor in operation, through the working chamber, from the inlet 6 in the direction of the outlet 7.

By means of this displacement, the working medium is suctioned into the chamber 4 through the inlet 6 and then moved out of the machine through the outlet 7.

For the orbital motion of the displacer, according to FIG. 1, a drive by means of a wobble rod 12 is provided. A crank drive 13, not shown in detail, is equipped on the crank side of the rod 12 with an articulation socket, in which the wobble rod 12 is seated rotatingly with a first spherical section 15. However, the invention is not restricted to this particular drive variant. Only a layout in which the wobble rod performs a wobbling and not a rotating motion is preferred, with the motion axis 30 being located on a conical circumference.

At the end opposite the first spherical section 15, the wobble rod 12 has a second spherical section 16. Coaxially with the principal axis 31 of the crank drive 13, the second spherical section 16 is supported in a stationary part of the housing 1, rotatingly and capable of wobbling.

In the plane of the rotor disk 3, the wobble rod 12 is equipped with a third spherical section 17, the spherical radius of which advantageously corresponds to that of the second spherical section 16. The third spherical section 17 is located rotatingly and wobbling in the hub of the rotor disk 3.

If the support locations for the two spherical sections 16 and 17 are cylindrical bearing bushings, for example, the centrifugal, purely radial forces would be supported on a semicircular line only. Axially directed forces could not be transmitted at all.

Those bearing locations are therefore in the form of hemispherical articulation sockets 18, 19. Because they are hemispherical, the number of individual parts is reduced and the installation is thereof simple.

This, however, is true only if the bearing surface of the spherical socket is within the same hemisphere. This condition leads to the fact that the articulation sockets 18, 19 for the second and third spherical sections are located as mirror images relative to each other, i.e., the bearing spherical surfaces are facing away from each other.

The axial force necessary to hold the spherical sections securely in their sockets under all operating conditions is applied by springs.

Figure 3:
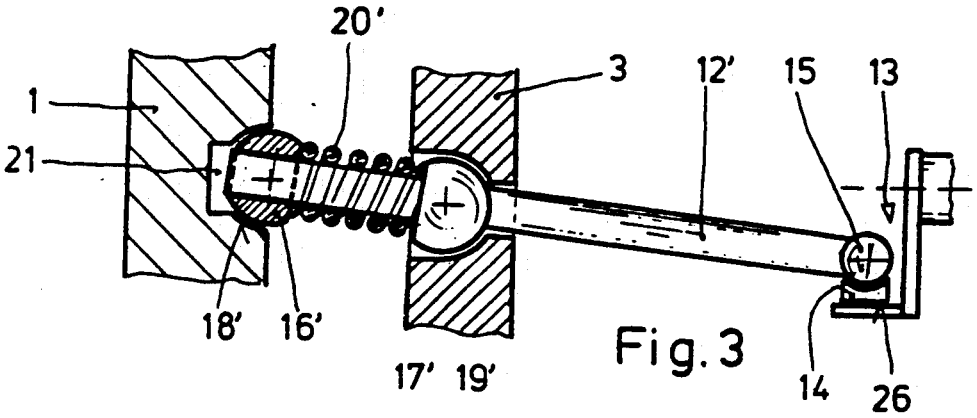
FIG. 3 is a view of a first installation variant of a wobble rod in a longitudinal section.

With reference to FIG. 3, in one embodiment the second spherical section 16' is provided with a center bore and set loosely onto the wobble rod 12', so that the second spherical section 16' may be displaced on the wobble rod. The facing surfaces of the spherical sections 16' and 17' are flattened so as to form a stop for a compression spring 20'. In the assembled state the spring 20' pressures the spherical sections apart. To receive the end of the wobble rod 12' when the spherical section 16' is displaced along the rod 12', the articulation socket 18' in the left half 1 of the housing is provided with a recess 21.

Figure 4:
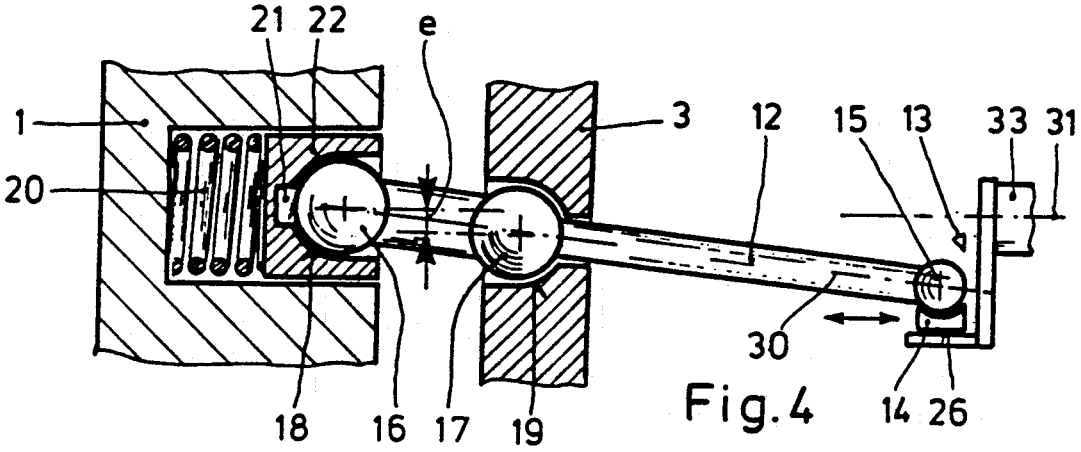
FIG. 4 is a view of a second variant of the installation of the wobble rod in longitudinal section.

With reference to FIG. 4, in another embodiment a sliding block is seated in an axially displaceable manner in the left housing part 1. In the frontal face of the sliding block 22 facing the rotor disk 3, an articulation socket 18 is formed. The spherical section 16 is located in the socket 18. To provide a defined spherical support at all times for the spherical section 16, the bottom of the socket 18 is provided with a recess 21, so that the top end of the spherical section 16 is never in contact with the bottom of the socket 18. The axial force is applied here by a helical spring 20, which is mounted between the housing part 1 and the sliding block 22.

Relative to the layout of FIG. 1, it should be mentioned that the spring force should be high enough so that the displacer 8 may be lifted from the lateral wall of the housing 1. The counter force maintaining the sealing effect is transmitted by the Oldham coupling 9, 10 to the rotor disk 3 of the displacer.

In any case, the spring force should be high enough so that the additional axial force in cooperation with the aforementioned radial force will support the spherical sections in a spherical surface. This spherical contact zone must be maintained in any case, independently of any material wear on any of the machine parts involved.

The following examples indicate possible defects that may be compensated by the invention:

In the course of the wobble motion, material may be removed from the ball. In this manner, the ball may score the socket. The diameters of the sphere and the socket are thereby reduced. In view of the constant spherical ball support the connection may be axially identical and free of clearances, although in addition to the reduction of the surface, the distance between the ball centers of the spherical sections 16 and 17 has increased. This condition is valid also, if only the balls or the sockets are abraded.

During the orbital motion the frontal sides of the displacer 8 may wear as a result of contact against the stationary housing 1. According to FIG. 1, this would reduce the distance between the spherical sections 16 and 17. This behavior is again rendered harmless without difficulty by the principles according to FIG. 3 and 4. In case of a change in the distance between the second and third spherical sections the angle on the conical circumference of the motion axis 30 also changes. This is also true for the distance between the spherical sections 16 and respectively 17 and 15. In each case, the eccentricity e (FIG. 4) on the displacer should be maintained. On the other hand, the plane of the second spherical section 16 determines the translation circle and is thus the reference plane. For this reason, the first spherical section 15 should also be displaceable. It should be displaceable firstly in the longitudinal direction of the wobble rod 12 as indicated in FIG. 4. Secondly, it should also be displaceable in the direction perpendicular to the plane of the drawing, in view of the aforementioned possible change in the angle. Preferably therefore, this first spherical section 15 is again embedded into a bearing bushing equipped with an articulation socket 14. The articulation socket 14 indicated in FIGS. 3 and 4, is in turn provided with a sliding surface 26, which is displaceable in all directions on a corresponding counter surface of the crank drive 13, the sliding surface 26 and the counter surface are both located in a plane parallel to the axis 31 of the crank drive 13.

The advantage of a wobble drive of this type may be stated by the following consideration: the highest radial force present in operation acts on the bearing combination 17/19. That radial force is absorbed by the two bearing combinations 15/14 and 16/18. The choice of lever arms between the spherical sections provides the means to keep the bearing load in the 15/14 combination as low as possible. Consequently, the dimensions of this bearing, in particular its ball diameter, may be small, with the result that the friction force will be low. On the other hand, the articulation sockets for the second and third spherical sections 16, 17 are not separate individual parts, but they are integrated into existing structural parts, on the one hand into the displacer, and on the other, into the stationary housing part or the sliding block. The solution is highly cost effective for this reason alone. As these articulation sockets are merely half shells without undercuts, the molding or pressing tools required for their manufacture are not expensive.

Figure 5:
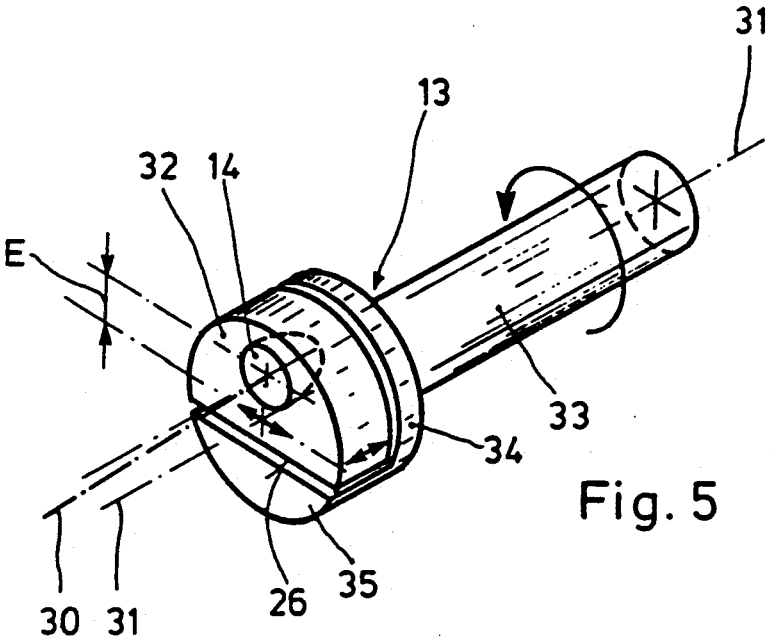
FIG. 5 is a perspective view of the wobble rod drive.

An example of the drive 13 for the wobble rod 12, 12' is shown in FIG. 5. The drive shaft 33 is provided with a collar 34 on the end of the shaft 33 facing the machine. The collar 34 is recessed on its frontal side in a manner such that a driving offset 35 is formed under the main axis 31. This has the aforementioned counter surface extending parallel to the main axis for the cooperation with the sliding surface 26. This is the crank drive 13 proper.

The bearing bushing 32 with the embedded articulation socket 14 to receive the spherical section 15 is somewhat smaller axially than the driving offset. This makes possible the displacement of the bushing 32 over the sliding surface 26 in the axial direction, as indicated by the arrows. The bushing 32 may also be displaced perpendicularly to the axial direction over the same sliding surface 26. In this manner, changes in the angle of the motion axis 30 may be compensated. The magnitude of the eccentricity E between the main axis 31 and the terminal point of the motion axis 30 is a function of the displacer eccentricity e and the translation ratio between the three bearing locations of the wobble rod 12, 12'.

An Oldham coupling is provided for the guidance of the displacer without rotation. It essentially comprises an intermediate ring 9, provided on its flat sides with lands 10, 10'. In the example shown, the lands 10 facing the rotor disk 3 may be displaced relative to the displacer on a common vertical axis. The lands 10 engage the correspondingly shaped grooves 11 in the rotor disk 3. The lands 10', which are offset by 90~ with respect to the lands 10, i.e., horizontal in this case and thus not shown in FIG. 1, are facing the stationary right half 2 of the housing and may be displaced relative to it on a common horizontal axis. The lands 10' slide in appropriately configured horizontal grooves 11' in the frontal side of the housing half 2.

Figure 6:
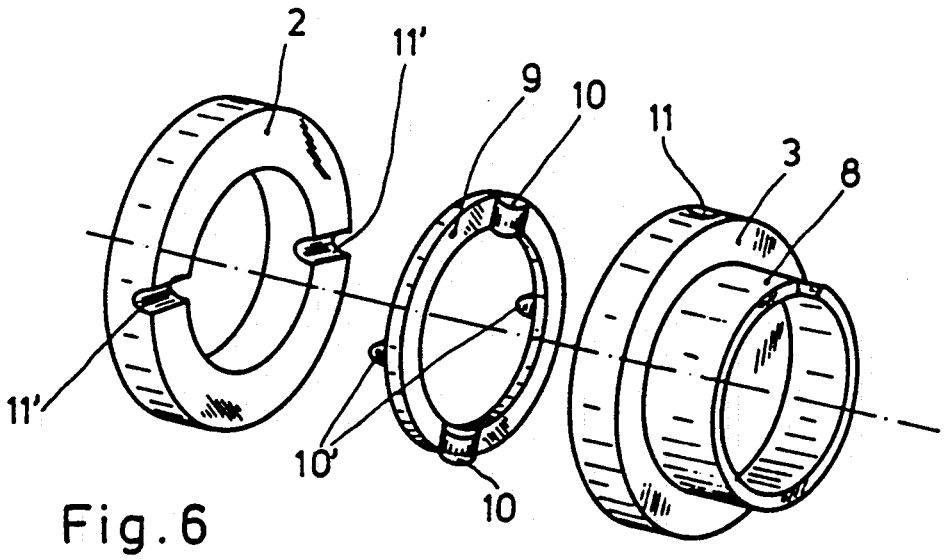
FIG. 6 is a perspective view of an Oldham coupling to be mounted.

The principle may be seen in FIG. 6, in which the hubs of the structural parts to be coupled are shown as simple rings. With reference to the pump shown in FIG. 1, the reference number 2 is used for the stationary housing part and the reference numbers 3 and 8 for the revolving rotor disk, together with the annular displacer 8.

Figure 7:
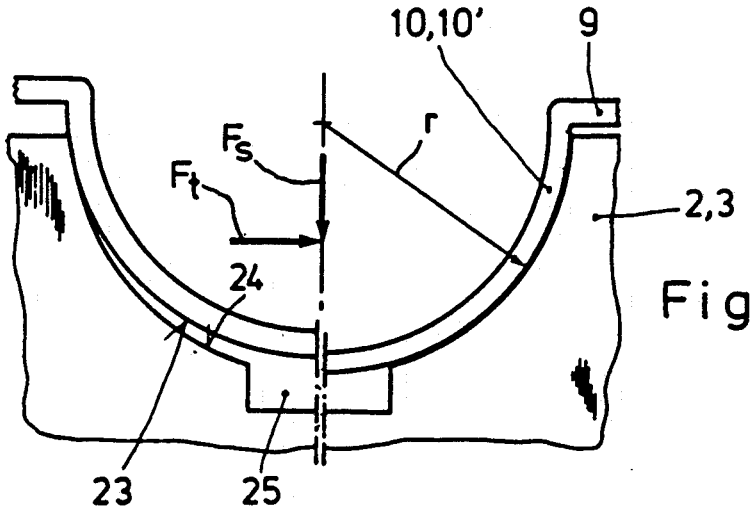
FIG. 7 is a view of the geometry of the frictional parts of an Oldham coupling.

The proper geometry of the parts sliding on each other is shown in FIG. 7. The convex frictional surface 23 of the land 10, 10' should coincide with the concave curvature of the wall of the groove 11, 11'. A circular shape with a radius r is chosen for both parts. The right half of FIG. 7 shows an inserted coupling in which the wall of the groove 11, 11' carries over the entire available surface. The left half of FIG. 7 shows the coupling prior to its insertion. Because of manufacturing inaccuracies or even an intentional difference in the radii of "ball and socket", the land 10, 10' is not fully in contact. In spite of this, it is carried over a considerable section on the upper edge of the groove 11, 11'. It may also be seen that jamming as a result of nonuniform material wear is not possible. The coupling is absolutely without clearance, regardless of the mutual position of the land and the groove.

The bottom 25 of the groove 11, 11' is offset rearward so that even with a complete insertion of the land into the groove there is no contact with the bottom. The recessed bottom of the groove prevents in any case the location of the load bearing zone in the head of the land, i.e. in the bottom of the groove. In such a case, as shown by experiments, a lateral clearance may develop between the wall and the lands.

The prevailing forces include firstly the contact pressure $F_s$, which according to FIG. 7 acts in the vertical direction, i.e., in the axial direction of the coupling. This force usually corresponds to a spring force, it is therefore in view of the minimal spring path, constant to some extent. Secondly, a horizontal force $F_t$ is acting on the vertical lands 10, which are variable relative to size and direction. Both of these are functions of the position and magnitude of the frictional forces between the annular displacer 8 and the wall of the working chamber 4.

The normal force acting on the load bearing wall 24 of the grooves is the resultant of the forces $F_s$ and $F_t$. It is therefore seen that the load along the bearing zone is not uniform. If $F_t$ is larger than $F_s$, the load in the upper segment section of the groove is higher than in the lower segment. It may further occur that upon a reversal of the force ratios the center vector of the reaction force slowly turns downward. Any migration of the force vector into the groove bottom must be prevented. The solution is the recessed groove bottom.

It is further seen in FIG. 7 that the intermediate ring 9 and the lands are of a single piece. It may consist of a deep-drawn workpiece, which has a favorable effect on production costs.

Figure 8:
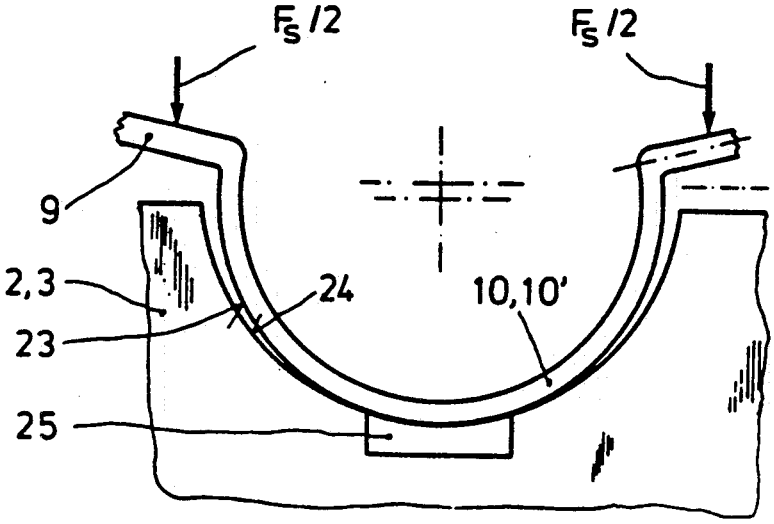
FIG. 8 is a view of an unstressed coupling with a prestressed intermediate ring.

The single piece is made of a corrosion resistant spring steel. As seen in FIG. 8, the intermediate ring is prestressed in order to obtain contact in the grooves without clearance under all conditions. In addition, the element also applies the necessary axial force to the rotor 3 to maintain the sealing action between the frontal sides of the displacer 8 and the working chamber 4.

As all of the conditions required to assure the tightness of the displacer in operation in spite of all possible axial and radial wear, are satisfied by the use of the wobble drive and the Oldham coupling, the curve geometry for the displacer and the working chamber can now be selected.

The desired low pulsation rate is obtained by having the inner and the outer working space communicating with each other at least on the outlet side. It is also advantageous if the working spaces are connected with each other relative to flow on the inlet side, as explained hereinbelow. In each of the working spaces the inlet must be separated from the outlet by at least one sealing line. Furthermore, every working space must have instantaneously two sealing lines applied directly to the inlet and the outlet, if sealing is to be effected over a full 360°. The curves of the displacer and the working chamber must further form a common tangent at their contact locations, wherein as the result of the identical direction of motion, the tangents at the inner and outer contact locations must be parallel to each other. The distance between the inner and the outer tangents corresponds to a first dimension of the piston cross section. The other dimension is determined by the depth of the displacer ribs projecting into the working chamber, and is constant over the entire extent of the working chamber. It follows that for an absolutely uniform, i.e., pulsation free conveyance, the tangent distance must be constant over the entire 360°. However, this condition cannot be satisfied because between the inlet 6 and the outlet 7 the land 5 must be present, and for this reason the displacer must be interrupted at this location. In addition, the free space of the ends of the displacer created by the translation motion must also be considered. These ends must not contact during their revolution the land with their frontal surfaces.

This defines all of the conditions to determine the maximum dimension of the distance between the ends of the displacer, referred to hereafter as the gap L. This condition is diagrammed in FIG. 9, wherein, the displacer 8 shown in solid lines is in its upper position, i.e., its ends touch the outer circumferential walls of the working chamber. The outer sickle shaped working space 28 is thus closed by two sealing lines. The fact that the displacer 8 abuts with its lower part against the inner wall of the working chamber, is not shown in FIG. 9. Relative to the view in FIG. 2, in which the inner working space 27 is closed, the displacer is thus rotated by 180°.

Figure 9:
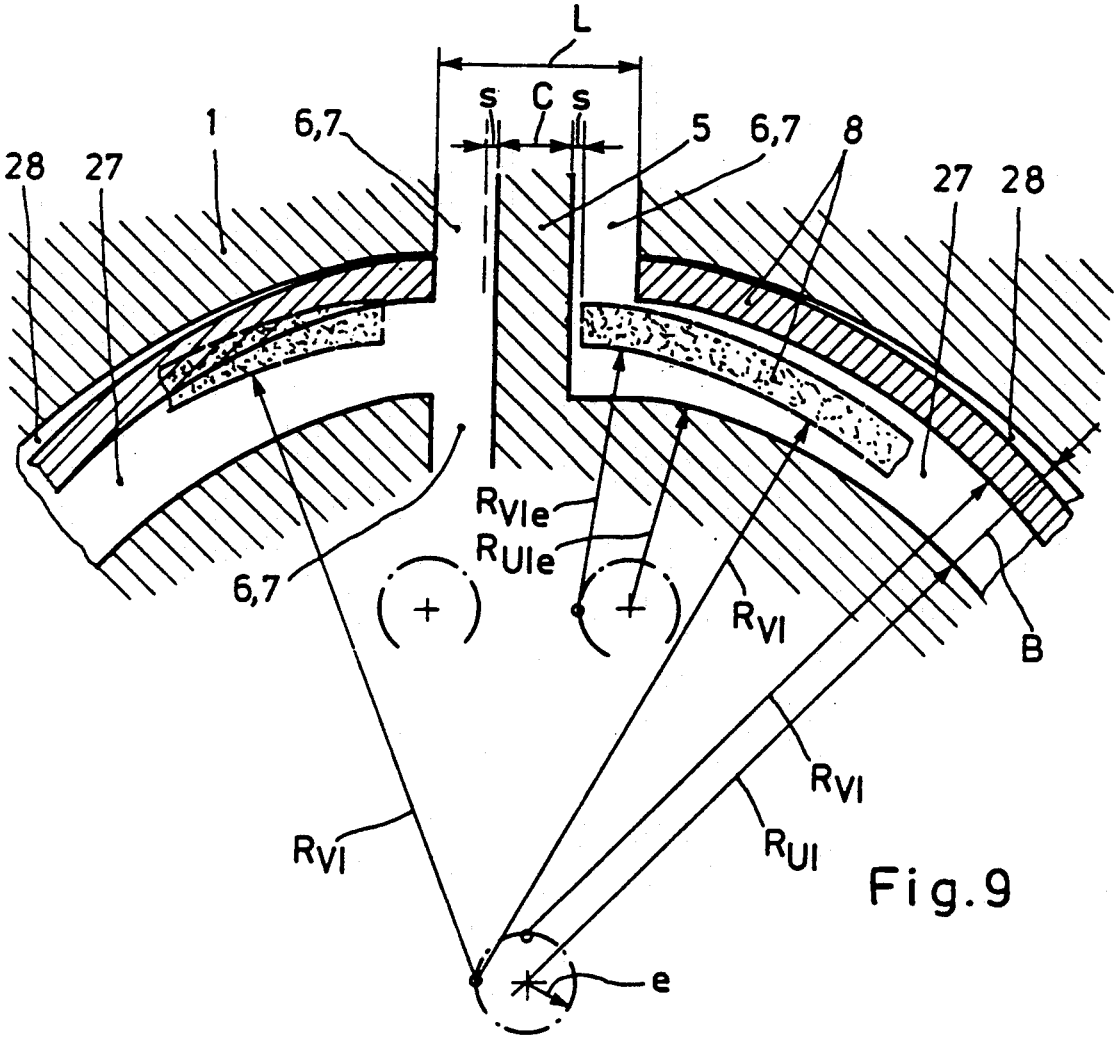
FIG. 9 is a view of the displacement geometry in the inlet and outlet area.

The displacer 8 indicated in FIG. 9 by dashed lines is located at the left hand stop, i.e., its right end is at its minimal distance s to the land 5. When choosing this minimum distance s, it should be considered that the displacer should not abut against the land 5, even in case of material wear during continued operation.

$R_{VIe}$ and $R_{UIe}$ are the corresponding inner radii of the ends of the elements on the inlet side (6) and the outlet side (7). These radii of curvature are smaller, which is to be explained later.

It is seen immediately that the maximum dimension of said distance, i.e., the width of the gap L is determined by the sum of the thickness C of the land 5 plus twice the minimum of s plus twice the eccentricity e.

Following the dimensioning of the so-called gap, the following conditions should be satisfied to determine the displacer geometry itself:

The curve should not include straight parts, as in such a section the medium would be squeezed out. The curve further should not have breaking points, i.e. all of the centers of the partial curves to be combined should be within the resultant curve. Otherwise, the contact lines would not be displaced continuously, as they would jump over partial sections.

Figure 10:
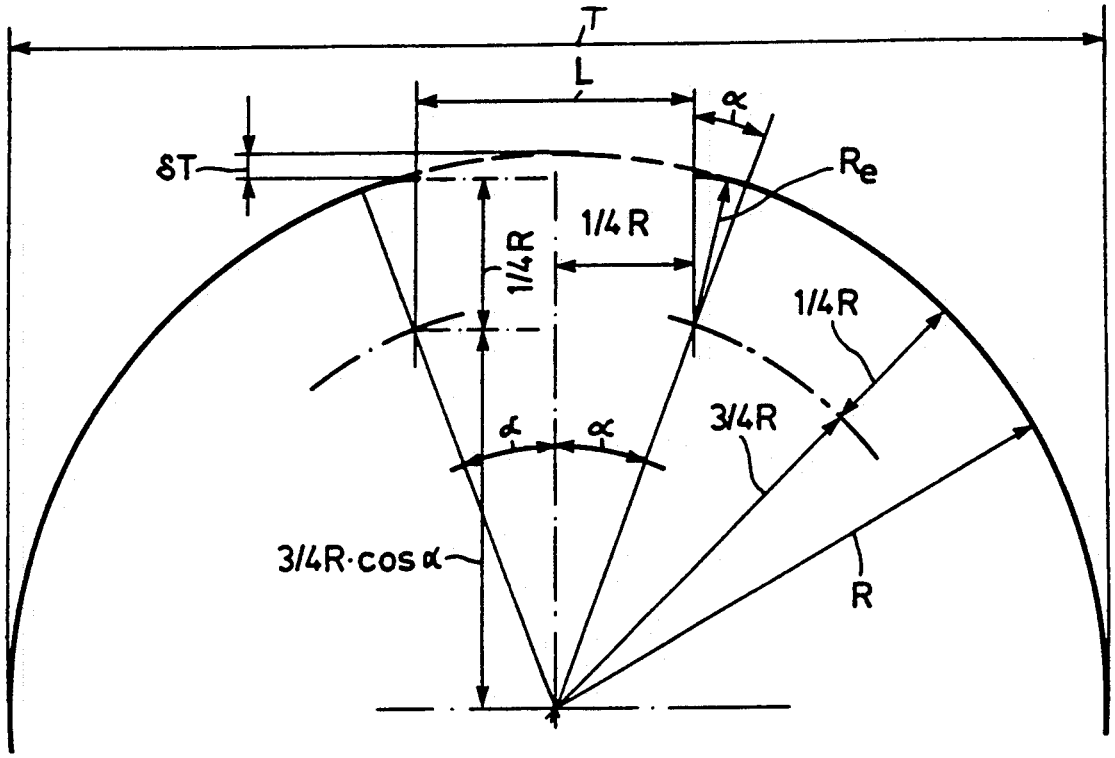
FIG. 10 is a view of a diagram for the determination of the curve geometry.

All of the above defines as the ideal form for the displacer and the working chamber a circular configuration. With consideration of the necessary gap width, the displacer and working chamber would therefore be circular over the major portion of their circumference. To satisfy the condition of tightness over 360°, for the ends on the inlet and outlet side of the displacer and the working chamber, appreciably smaller curving radii are selected over a maximum angular range $\alpha$ of 30°. The so-called overwhelming circumference thus extends at least over $360° - 2 \times 30° = 300°$ in a purely circular form. The effect on the variation of the volume conveyed of this is shown by the numerical example explained relative to FIG. 10:

The diagram is self explanatory. R designates a symbolic radius, valid for both the displacer and the walls of the working chamber. This is the radius prevailing over most of the circumference. $R_e$ designates the radius of curvature at the ends of the corresponding element, prevailing over the contact angle $\alpha$. The distance between the tangents, the variation during one revolution of the displacer determines the pulsation of the medium being transported, is designated by T.

For an illustration, it is now assumed that the gap L should have a width of $\frac{1}{2}$ R. The radius of curvature $R_e$, which must be significantly smaller than R, is assumed to be $\frac{1}{4}$ R. This yields:

$$\sin \alpha = \tfrac{1}{4} * R : \tfrac{3}{4} * R = \tfrac{1}{3}$$

$$\alpha = 19.47°$$

The difference $\delta T$ caused by the deviation from the pure circular form in the tangential distance then becomes:

$$\delta T = R - \tfrac{3}{4} * R * \cos \alpha - \tfrac{1}{4} * R = 0.043$$

This leads to a variation in the volume transported in [%] of:

$$\delta M = 100 * \delta T / 2 * R = 2.14\%$$

This shows that in the example chosen pulsation is extraordinarily low and that it increases with rising values of the angle $\alpha$.

The width of the gap L is important for another reason also. Space with an adequately large cross section should be provided for the location of the inlet 6 and the outlet 7. Let us again consider FIG. 9. It is seen in the left half of the figure that both the inner and the outer circumferential wall of the working chamber are interrupted in the same plane as the displacer shown in solid lines. This interruption forms the radial inlet 6 or outlet 7, depending on the direction of rotation of the displacer 8. This layout therefore does not interfere with the sealing desired over the entire 360°, but shows that only a restricted space is available for the inlet and the outlet. According to the left half of the figure, the medium can flow radially from above to below. Even if the displacer in this case has a minimum distance s, there is no problem in filling and emptying the inner and outer working chambers 27, 28.

Figure 11:
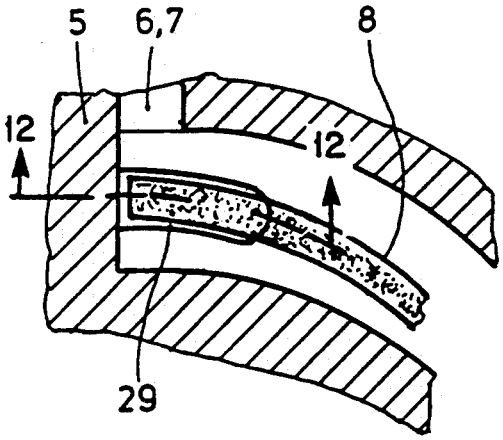
FIG. 11 is a view of a possible connection between the inner and outer working chamber.
Figure 12:
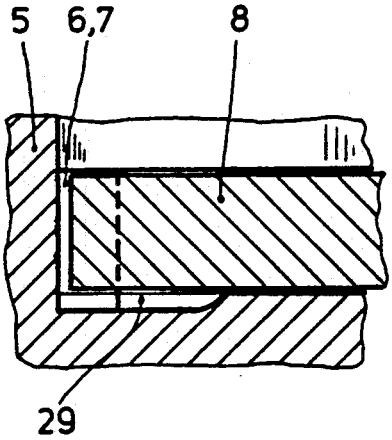
FIG. 12 is a cross section on the line 12—12 in FIG. 11.
Figure 13:
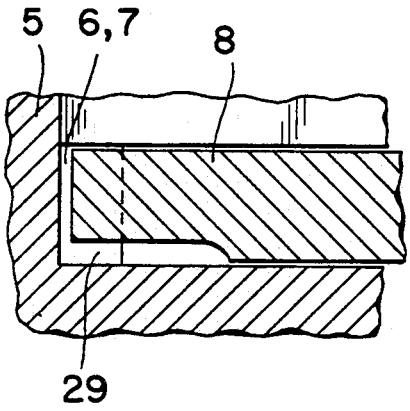
FIG. 13 is a cross section of another possible connection between the inner and outer working chamber.

The case is different in the right half of the figure, where there is no lower inlet channel. It is seen in the position of the dashed line displacer, that any communication between the two working spaces 27 and 28 may take place over the distance s only. Obviously, this is much too little to insure the uniform filling of the inner working space 27. The solution consists according to FIG. 11 and 12 and FIG. 13 of recessing the bottom of the working chamber of the frontal side of the displacer in the area of the inlet and the outlet. This recess 29, which is somewhat wider than the thickness of the displacer 8, is located in the center of the channel. It makes possible the ready flow of the working medium in the end position shown of the body, from the outer working space 28 under the body, into the inner working space 27. The width of the recess 29 is such that in the displacer positions shown in solid lines in FIG. 2 and 9, there is a slight overlap.

The abovedescribed configuration is based on that both the inlet and the outlet are located in the stationary part of the housing. It may be, however, that one of the two openings 6 or 7 is located in the displacer itself. In this case, a corresponding recess should be provided on the frontal side of the rotor in the inlet or outlet zone. This again should have a width larger than the thickness of the displacer, so that the outer and the inner working spaces communicate with each other. The recess here is located under the displacer rib, i.e., the rib is not in contact at this location with the frontal side of the rotor. It is possible with this solution to suction in the working medium through the inlet in the stationary part of the housing and to eject it through the outlet in the displacer into the inside of the machine. There it could for example lubricate and/or cool the drive and guide elements involved. In this case the packing box seal otherwise required between the drive shaft and the housing may be eliminated.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A positive displacement machine for incompressible media, comprising:

a stationary housing;

a working chamber having inner and outer circumferential walls separated by a bottom surface, an inlet and an outlet, said working chamber being located in the stationary housing and having the configuration of a circular slot;

a land extending from said housing into the working chamber;

said inlet being separated from said outlet by said land;

a disk shaped rotor located within said housing and driven eccentrically relative to the housing;

a circular displacer body located in said working chamber and being held on said disk shaped rotor so as to be driven eccentrically relative to the housing in a manner such that in operation the circular displacer carries out a circular motion limited by the circumferential walls of the working chamber;

the curvature of said displacer is dimensioned relative to the curvature of the working chamber so that the displacer contacts the inner and outer circumferential walls of the working chamber at a sealing line continuously progressing in operation, thereby dividing the working chamber into inner and outer work spaces, by which work spaces the medium is conveyed from the inlet to the outlet;

said displacer body being interrupted in the area of said land;

a coupling is provided for interconnecting the displacer body relative to the housing;

a wobble rod connected to said displacer body and a driving crank connected to said wobble rod wherein said wobble rod as driven by said driving crank provides for the circular motion of the displacer body;

in the area of the land, the inner and outer work spaces communicate with each other at the inlet and the outlet;

the displacer body and the working chamber have an at least approximately circular configuration over the overwhelming part of their configuration;

the displacer body being arranged so as to seal over at least 360°;

wherein an end of said displacer body on an inlet side of the displacer body and the working chamber and an end of the displacer body on an outlet side of the displacer body and the working chamber, in an angular zone $\alpha$ of maximum 30°, each have significantly smaller radii of curvature than that of the overwhelming circumference.

2. The positive displacement machine according to claim 1, wherein the inlet and the outlet are located in the stationary housing directly at the land and open radially into the working chamber, and the bottom surface of the working chamber includes a recessed portion for allowing fluid communication between said inner and outer work spaces, said recessed portion being located in the area of the inlet and the outlet.

3. The positive displacement machine according to claim 1, wherein the inlet and the outlet are located directly at the land and open radially into the working chamber, and the frontal side of the displacer includes a recessed portion for allowing fluid communication between said inner and outer work spaces, said recessed portion being located in the area of said inlet under the displacer body.

4. The positive displacement machine according to claim 1, wherein:

the wobble rod includes first, second, and third spherical sections;

the wobble rod is seated on its end on the side of the crank with the first spherical section in an articulation socket of the crank;

the wobble rod is supported at its other end with the second spherical section in a hemispherical articulation socket of the stationary housing, and between the its two ends the third spherical section of the wobble rod is supported rotatingly and wobblingly in a hemispherical articulation socket in the hub of the displacer;

said positive displacement machine further comprising spring means insuring the full abutment of the spherical sections in the articulation sockets.

5. The positive displacement machine according to claim 4, wherein the second spherical section is set loosely on the wobble rod, and the spring means comprises a helical spring located between the second and third spherical sections.

6. The positive displacement machine according to claim 4, further comprising a sliding block in which is arranged the articulation socket provided to hold the third spherical section, said sliding block being displaceable under a spring load in the stationary housing.

7. The positive displacement machine according to claim 4, wherein the articulation socket arranged to hold the first spherical section is displaceable in a plane parallel to the axis of the crank drive.

8. The positive displacement machine according to claim 1, wherein the coupling comprises a freely moving intermediate ring, carrying on its flat sides two sets of lands arranged at 90° to each other for engaging corresponding grooves in the housing and rotor, with said lands being convex at friction surfaces and wherein the load bearing walls of the grooves are correspondingly concave to hold said lands, and that the bottom of the grooves is recessed to prevent contact with the land.

9. The positive displacement machine according to claim 8, wherein the friction surfaces of the lands and the load bearing surfaces of the grooves have a circular cross section.

10. The positive displacement machine according to claim 8, wherein in that the intermediate ring is an integral prestressed part together with the lands made of spring steel.

11. The positive displacement machine according to claim 1, wherein the land extends radially within said working chamber.

12. The positive displacement machine according to claim 1, wherein the coupling is an Oldham coupling.

13. The positive displacement machine according to claim 1, wherein the inlet and the outlet are located directly at the land and open radially into the working chamber, and the frontal side of the displacer includes a recessed portion for allowing fluid communication between said inner and outer work spaces, said recessed portion being located in the area of said outlet under the displacer body.

* * * * *